United States Patent [19]

Nabetani

[11] Patent Number: 4,750,845

[45] Date of Patent: Jun. 14, 1988

[54] SHAKER

[75] Inventor: Yoshiyuki Nabetani, Saitama, Japan

[73] Assignee: Taiyo Scientific Industrial Co. Ltd., Tokyo, Japan

[21] Appl. No.: 859,923

[22] Filed: May 5, 1986

[30] Foreign Application Priority Data

Feb. 19, 1986 [JP] Japan ..... 61-032720

[51] Int. Cl.[4] ..... B01F 11/00

[52] U.S. Cl. ..... 366/208; 335/219; 366/209

[58] Field of Search ..... 366/208, 110, 111, 112, 366/209, 219; 74/67, 68, 69, 86; 51/6, 163.1; 335/219; 209/332

[56] References Cited

U.S. PATENT DOCUMENTS

| | | | |
|---|---|---|---|
| 681,254 | 8/1901 | Northway | 74/86 |
| 1,425,722 | 8/1922 | Tempelaar | 366/208 X |
| 2,337,453 | 12/1943 | Corey et al. | 51/6 |
| 2,645,189 | 7/1953 | Hansalik | 209/332 X |
| 3,171,159 | 3/1965 | Cunder et al. | 366/111 X |
| 3,310,292 | 3/1967 | Moore | 366/111 |
| 3,537,719 | 11/1970 | Gottfried | 335/219 X |
| 3,728,923 | 4/1973 | Lanore | 74/86 X |

*Primary Examiner*—Harvey C. Hornsby
*Assistant Examiner*—Scott J. Haugland
*Attorney, Agent, or Firm*—Holman & Stern

[57] ABSTRACT

Shaking area of the shake table of a motor-driven shaker used for shake culture and the like can be enlarged or reduced by adjusting the eccentricities of plural support legs with respect to corresponding shafts. According to the present invention, mere adjustment of the eccentricity of a central support leg results in automatical eccentricity adjustment of the other peripheral support legs each having a magnet secured thereto which slidably engages with a free disc per se rotatable with its shaft, since the magnet is driven while generating a circle on the free disc following an eccentrical movement of the central support leg and such circle ought to coincide of itself with a concentrical circle with respect to the shaft.

2 Claims, 3 Drawing Sheets

SHAKER

BACKGROUND OF THE INVENTION

This invention relates to a shaker of the type having a shake table and a plurality of support legs which are eccentrically driven with respect to their shafts respectively.

Conventional shakers used in shake culture and the like include those shown in FIGS. 6–8, each of support legs A has threaded lower end which is screwed in one of tapped holes B eccentrically arranged on or through a central support disc D. The central support disc D secured to a central shaft C is rotated by a motor 3, while the peripheral support discs D' such as those disposed on four corner portions of a fitting plate 2 shown in FIG. 7 are rotated by the support legs A' which are per se eccentrically driven around the shafts C' respectively, since the peripheral support legs A' are secured to a back plate 7*a* of a shake table 7 which is driven through the central support leg A and the central disc D by the motor 3. With this arrangement, the locations or distances of the peripheral support legs A' relative to or from the tapped holes B' of the support discs D' must be exactly identical with each other, and if there exist any discrepancies between them, for example as shown in FIG. 7, it is either difficult or impossible to mount the shake table 7 on the discs D, D' with the threaded end portions fully screwed in the tapped holes B, B'. Further, with this arrangement, it is difficult or impossible to adjust or change the eccentricity of the support legs A, A' from the shafts C, C', and if required to doso, the formers A, A' themselves must be substituted with appropriate ones which have such desired eccentricity.

While, another prior art shaker of FIG. 8, viz., in Japanese Patent Publication No. 36-6950 can be advantageously adjusted or changed with respect to the eccentricity of the support legs A, A' from the shafts C, C' with employment of such construction that contains an adjust screw E which laterally moves the shaft A and a plurality of perpheral adjust sleeves F which can be moved on support rods H and fastened by screws G; in FIG. 8, a transmission belt from the motor 3 is not illustrated. However, this arrangement is very complicated in construction and further such adjustment must be effected each time with respect to every peripheral support legs A'.

SUMMARY OF THE INVENTION

It is therefore an object of the present invention to provide a shaker of the construction in which a central and perpheral support legs for a single shake table are easily adjusted in their eccentricities with respect to respective rotation shafts.

It is another object of the present invention to provide a shaker characteristically comprising a plurality of peripheral magnets each held by a peripheral support leg and slidably engaging with a peripheral free disc whereby the eccentricity adjustment of the support leg can be automatically effected by simply adjusting a central support leg.

For a further understanding of the present invention and for features and advantages thereof, reference may be made to the following description and the drawings which illustrate a preferred embodiment of shakers in accordance with the present invention.

PREFERRED EMBODIMENT OF THE INVENTION

Figure 1:
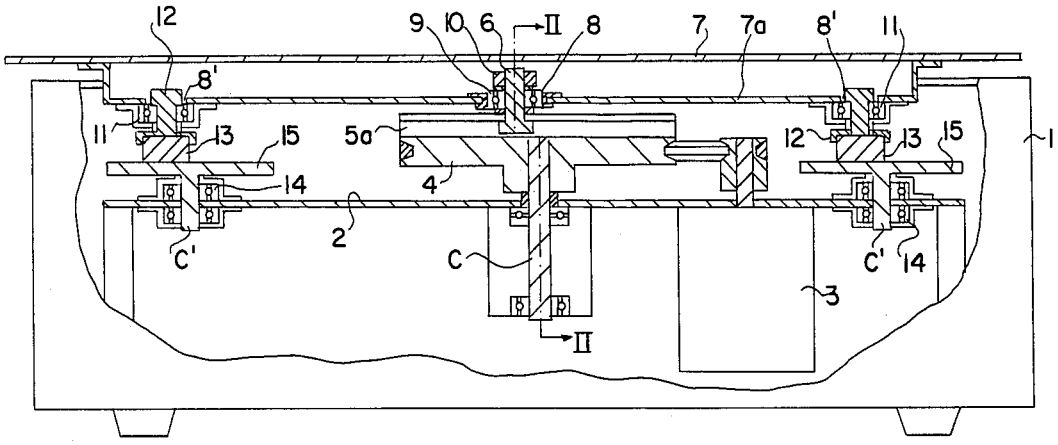
FIG. 1 is a front view partly sectional of one embodiment of shakers in accordance with the present invention.
Figure 2:
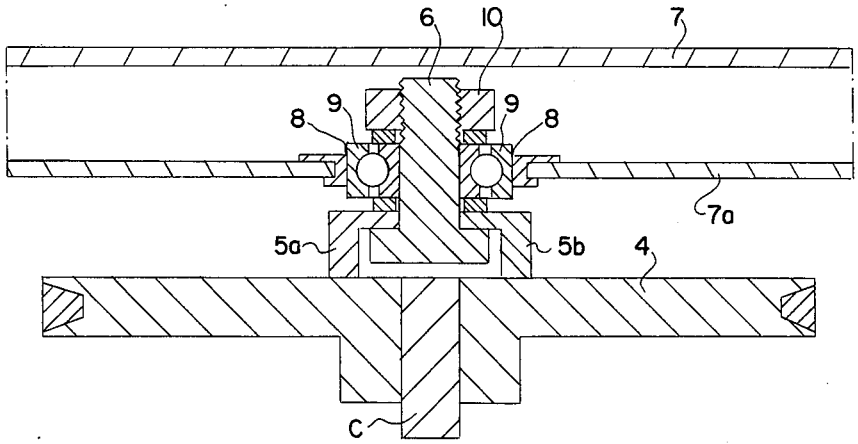
FIG. 2 is a fragmentary enlarged view taken along line II—II of FIG. 1.

Referring to the drawings, particularly to FIGS. 1, 2, one embodiment of shakers in accordance with the present invention includes a housing 1 of open box type; a horizontal fitting stand 2 installed on the base of the housing; a driving motor 3 suspended under the fitting stand 2; a driving disc 4 centrally arranged on the fitting stand 2 with its rotation shaft C extending downward therethrough; said driving disc being interlocked to the driving shaft of the electric motor 3 by a transmission belt; a pair of L-shaped rails 5*a*, 5*b* cooperatively forming a channel therebetween and respectively fixed on the upper surface of the driving disc 4, said pair of L-shaped rails 5*a*, 5*b* being substitutable by a channel bar with bottom or closed portion thereof fixed on the driving disc 4; a central support leg 6 with enlarged lower portion inserted in the channel, said central support leg 6 being fastened in any place eccentrical with respect to the central shaft C by a nut 10, but being slidable when required for adjustment; a shake table 7 having a back plate 7*a* with a central fitting hole 8 and a plurality of peripheral fitting holes 8' formed therethrough; a rolling-contact bearing 9 inserted in the central fitting hole 8 and holding the central support leg 6 rotatably therein; a plurality peripheral rolling-contact bearings 11 each installed in the corresponding peripheral fitting hole 8' on four corners of the back plate 7*a* and holding a corresponding peripheral support leg 12 rotatably therein; a plurality of permanent magnets 13 each securely held by the lower grip portion of the corresponding support leg 12, said magnet being circular in plan view and having flat bottom face; a plurality of peripheral rolling-contact bearings 14 each installed in a corresponding fitting hole on four corners of the fitting stand 2; and a plurality of free discs 15 each having a shaft C' held by the peripheral rolling-contact bearing 14 rotatably therein, said free discs being made of a magnetically soft material to be attracted by the magnets.

The magnets 13 can be slidably positioned on the free discs 15 when initially placed thereon. Here, the magnetism or attractive force of the magnet 13 is set to such a value as lower than the rotational force of the motor 3.

As constructed above, the shake table 7 assembled together with the peripheral support legs 12 through respective rollingcontact bearings 11 can be easily mounted above the fitting stand 2 through the peripheral free discs 15 and the peripheral rolling-contact bearings 14 while putting the back plate *7a* through the central fitting hole 8 onto the set of central support leg 6, rolling-contact bearing 9 and paired rails *5a, 5b* and driving disc 4 previously assembled together and fastened by the nut 10 to the channel between the rails *5a, 5b*.

Figure 3:
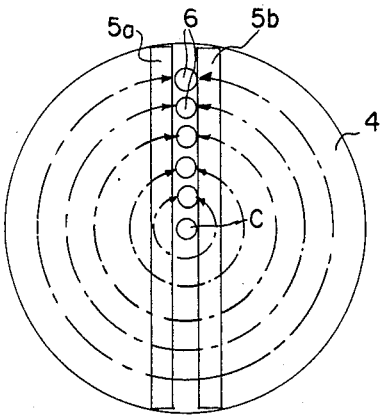
FIG. 3 is a schematic view showing the adjustment of eccentricity of a central support leg with respect to a central shaft.
Figure 4:
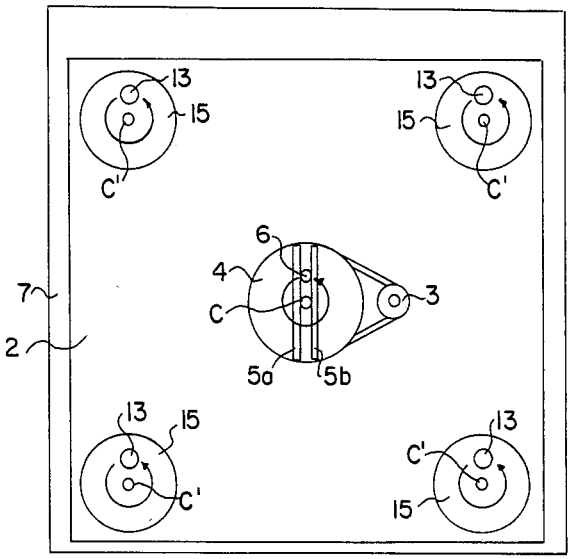
FIG. 4 is a schematic view showing the motions and eccentricities of a central driving disc and four peripheral support discs with respect to respective shafts.

Ahead of this operation, the eccentricity of the central support leg 6 with the respect to the central shaft C can be easily adjusted or changed by sliding the support leg 6 between the channel to a desired position (cf. FIG. 3) and those of the peripheral support legs 12 with respect to the corresponding shafts C' need not be manually adjusted or changed since they can be automatically normalized (cf. FIG. 4) as described below when the central driving disc 4 is rotated by the motor 3 to eccentrically drive the central support leg 6.

Figure 5:
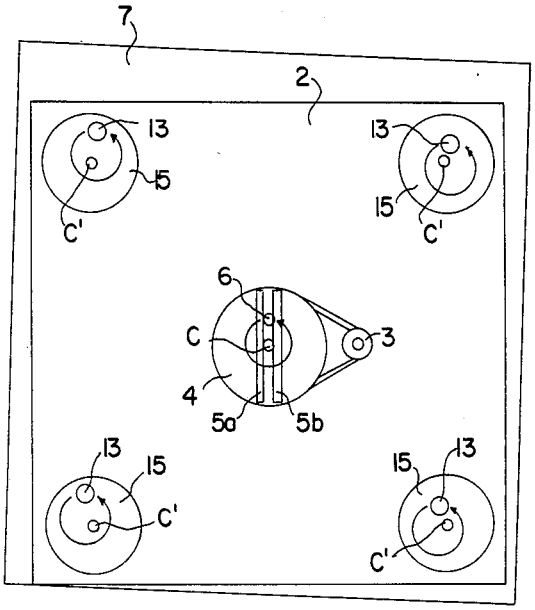
FIG. 5 is a schematic view showing an example in which a shake table has been mounted with four support legs positioned at random on respective support discs.
Figure 7:
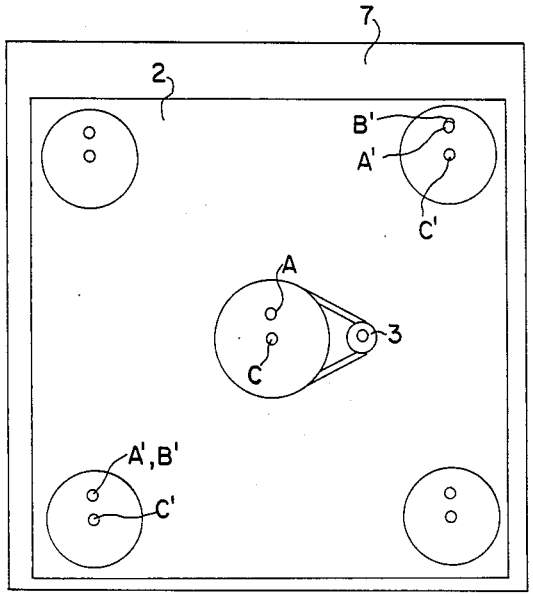
FIG. 7 (PRIOR ART)
FIG. 7 is a schematic view showing an example of discrepancy between support legs and tapped holes therefor.
Figure 6:
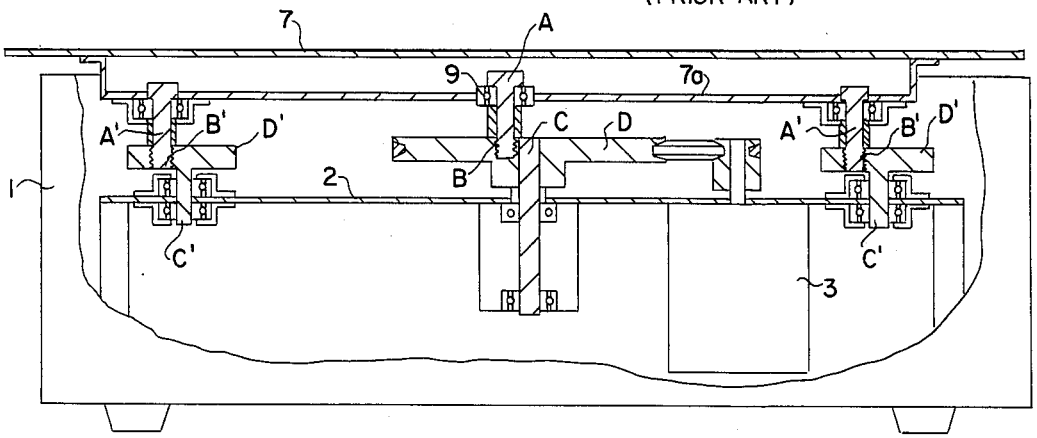
FIG. 6 (PRIOR ART)
FIG. 6 is view similar to FIG. 1, showing a prior art shaker.
Figure 8:
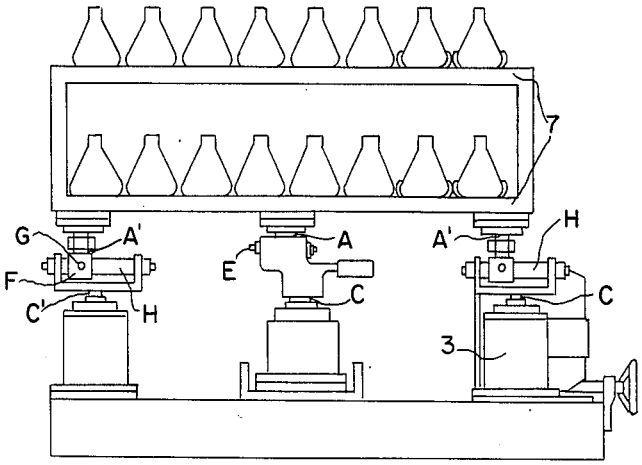
FIG. 8 (PRIOR ART)
FIG. 8 is a view similar to FIG. 1, showing another prior art shaker.

Supposed now that the shake table 7 is placed abnormally, with the permanent magnet 13 positioned at such spots on the respective peripheral free discs 15 as shown in FIG. 5, then each magnet 13 is driven while generating a circle on the surface of the disc 15 following the eccentrical movement of the central support leg 6. However, since the disc 15 itself is driven by magnet 13 slidably engaging therewith, the circle generated by the magnet is inforced to move to and coincide with such a circle on the disc that has the same radius and center so as to provide the support legs 12 and the magnet 13 with a natural and comfortable position, shifted from such a unnatural and uncomfortable position as shownin FIG. 5.

Accordingly, the shake table 7 can be easily rearranged to such normal or natural posture that provides most preferred shaking condition for shake culture and the like. Further, for adjusting the eccentricities of the central support leg 6 and the peripheral support legs 12 with respect to the central shaft C of the driving disc 4 and the shafts C' of the peripheral free discs 15 so as to enlarge or reduce the shaking area of the shake table 7, only the central support leg 6 need be moved to, and fastened by the nut 10 at, a desired spot between the paired rails *5a, 5b*. The eccentricities of the peripheral support legs with respect to the shafts C' of the respective peripheral free discs 14 can be automatically adjusted as described above.

It is to be noted that the shakers in accordance with the present invention are quite simple in construction and operation and that the shake table 7 together with the peripheral support legs 12 assembled thereto can be easily mounted on the peripheral free discs 15 and the central assembly of the support leg 6, the paired rails 5a, 5b, and driving disc 4; here, the central assembly being already eccentrically adjusted to a desired position. If desired, an eye-hole (not shown) may be formed on the shake table 7 above the central support leg 6 so as to secure exact mounting of the shake table 7 on the above central assembly through the fitting hole 8, or alternatively, the shake table 7 itself may be made of any transparent material.

Further, although the central support leg 6 has been described as installed to the driving disc 4 adjustably through the paired rails *5a, 5b* with respect to the central shaft C, it may naturally be directly and adjustably installed to the disc 4, for example, by screwing its lower end in one of the fitting holes (not shown) concentrically formed on the driving disc 4. Thus, it is understood that the present disclosure has been made only as an example and the scope of this invention is not limited to such disclosure.

What is claimed is:

1. A shaker used for shake culture and the like, comprising: a horizontal fitting stand; a motor installed on the fitting stand; a driving disc centrally arranged on the fitting stand with a rotation shaft extending forward therethrough, said driving disc being connected with a driving shaft of the motor by a transmission means; a central support leg installed through a fixture to the driving disc, said central support leg being eccentrically adjustable with respect to the rotation shaft of the driving disc; a shake table having a back plate with a central fitting hole and a plurality of peripheral fitting holes; a rolling-contact bearing rotatably holding the central support leg; a plurality of peripheral support legs held by a plurality of peripheral rolling-contact bearings in the peripheral fitting holes; a plurality of free discs each having a rotation shaft rotatbly held by a further roller contact bearing on the fitting stand; and a plurality of peripheral magnets each securely held by one of the peripheral support legs in sliding engagement with one of the free discs, a magnetic attraction force being established between each magnet and the respective free disc which force is less than a rotation force produced by the motor so as to promote eccentric self adjustment of the magnets to conform with the eccentricity of the central support leg.

2. A shaker according to claim 1, wherein the fixture to the driving disc is a combination of an enlarged lower pportion of the central support leg and a pair of L-shaped rails cooperatively forming a channel therebetween and respectively fixed on the upper surface of the driving disc.

* * * * *